US010756474B1

(12) United States Patent
Sun et al.

(10) Patent No.: US 10,756,474 B1
(45) Date of Patent: Aug. 25, 2020

(54) PLUG CONNECTOR

(71) Applicant: Cheng Uei Precision Industry Co., Ltd., New Taipei (TW)

(72) Inventors: Yang-Yang Sun, Dong-Guan (CN); Ming-Wei Lee, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/506,943

(22) Filed: Jul. 9, 2019

(30) Foreign Application Priority Data

Feb. 27, 2019 (CN) ..... 2019 2 0247206 U

(51) Int. Cl.
*H01R 13/504* (2006.01)
*H01R 4/02* (2006.01)
*H01R 13/66* (2006.01)

(52) U.S. Cl.
CPC ..... *H01R 13/5045* (2013.01); *H01R 4/02* (2013.01); *H01R 13/665* (2013.01)

(58) Field of Classification Search
CPC ..... H01R 3/5045; H01R 3/665; H01R 3/641; H01R 3/7175; H01R 4/02
See application file for complete search history.

(56) References Cited

U.S. PATENT DOCUMENTS

| | | | | |
|---|---|---|---|---|
| 9,660,396 | B2 * | 5/2017 | Chen | H01R 13/6675 |
| 9,698,544 | B2 * | 7/2017 | Wu | H01R 13/7175 |
| 10,333,263 | B2 * | 6/2019 | Wu | H01R 24/64 |
| 2016/0020556 | A1 * | 1/2016 | Soos | H01R 13/641 439/489 |
| 2016/0093987 | A1 * | 3/2016 | Wu | H01R 13/665 439/620.22 |
| 2016/0149353 | A1 * | 5/2016 | Chen | H01R 13/6675 439/490 |
| 2016/0322761 | A1 * | 11/2016 | Wu | H01R 13/7175 |
| 2016/0329664 | A1 * | 11/2016 | Wu | H01R 13/7175 |
| 2019/0020157 | A1 * | 1/2019 | Wu | H01R 9/0515 |

* cited by examiner

*Primary Examiner* — Abdullah A Riyami
*Assistant Examiner* — Nader J Alhawamdeh
(74) *Attorney, Agent, or Firm* — Cheng-Ju Chiang

(57) ABSTRACT

A plug connector having a firmly fastened protecting element includes a main body, an integrally molded outer shell surrounding the inner shell, and a protecting element. The main body includes a circuit board, a connecting element, a soldering element and an inner shell. The connecting element includes an assembling end, and a function end connected with the assembling end. The assembling end is adjacent to and is connected with one end of the circuit board. The soldering element is connected with the other end of the circuit board. The inner shell is fastened between the connecting element and the soldering element. The inner shell surrounds the circuit board. The protecting element is fastened to one end of the main body adjacent to the assembling end. The protecting element includes a connecting end combined with and is fastened to one end of the outer shell away from the soldering element.

6 Claims, 6 Drawing Sheets

PLUG CONNECTOR

CROSS-REFERENCE TO RELATED APPLICATION

The present application is based on, and claims priority form, China Patent Application No. 201920247206.2, filed Feb. 27, 2019, the disclosure of which is hereby incorporated by reference herein in its entirety.

BACKGROUND OF THE INVENTION

1. Field of the Invention

The present invention generally relates to a connector, and more particularly to a plug connector having a firmly fastened protecting element simplifying a manufacturing process and manufacturing procedures thereof.

2. The Related Art

With the popularity of electronic products, various plug connectors matched with the electronic products are emerged accordingly. A conventional plug connector includes an outer shell made of a harder material. When the conventional plug connector is inserted into a docking port, because the outer shell is made of the harder material, the outer shell of the conventional plug connector easily scratches or abrades an outer cover of the electronic product to which the conventional plug connector is assembled, in a process of manufacturing the conventional plug connector, the conventional plug connector further includes a protecting element made of a silicone material, and adhesives dispensed on a surface of the protecting element, then the outer shell is sleeved around a rear of the protecting element. When the conventional plug connector is inserted into the docking port, the outer shell of the conventional plug connector is isolated from the outer cover of the electronic product by virtue of the protecting element. Thereby the outer cover of the electronic product is uneasily scratched or abraded.

However, in a manufacturing process of the conventional plug connector, a solidification of the adhesives need several hours to fasten the rear of the protecting element and the outer shell, and moreover in a process of using the conventional plug connector, when the conventional plug connector is in use and the adhesives between the rear of the protecting element and the outer shell lack of a solidification performance, a risk of the protecting element being separated from the outer shell will be even happened. Thus the conventional plug connector has longer manufacturing time, a complex manufacturing process and complex manufacturing procedures, and quality of the conventional plug connector is hardly ensured.

In view of that, an innovative plug connector having a firmly fastened protecting element simplifying a manufacturing process and manufacturing procedures is essential to be provided, and quality of the innovative plug connector having a firmly fastened protecting element is ensured.

SUMMARY OF THE INVENTION

An object of the present invention is to provide a plug connector having a firmly fastened protecting element. The plug connector having a firmly fastened protecting element includes a main body, an integrally molded outer shell surrounding the inner shell, and a protecting element. The main body includes a circuit board, a connecting element, a soldering element and an inner shell. The connecting element includes an assembling end, and a function end connected with one end of the assembling end. The assembling end is adjacent to and is connected with one end of the circuit board. The soldering element is connected with and soldered on the other end of the circuit board. The soldering element includes a main portion, and a plurality of soldering strips integrally molded to the main portion. Two opposite ends of each soldering strip project beyond a front surface and a rear surface of the main portion. Each soldering strip has a soldering portion and a connecting portion. The soldering portion and the connecting portion project out of the main portion, and project beyond the front surface and the rear surface of the main portion. Each soldering strip is soldered on the other end of the circuit board by virtue of the connecting portion of each soldering strip being soldered on the other end of the circuit board, so that the main portion is fastened to the circuit board. Two opposite sides of the front surface of the main portion adjacent to the circuit board protrude frontward to form two protruding blocks towards the circuit board. The two protruding blocks are disposed opposite to and spaced from the connecting portions of the plurality of the soldering strips for mutually cooperating to clamp the circuit board. The inner shell is fastened between the connecting element and the soldering element. The inner shell surrounds the circuit board. The protecting element is fastened to one end of the main body adjacent to the assembling end. The protecting element includes a connecting end. The connecting end is combined with and is fastened to one end of the outer shell away from the soldering element. The connecting end is fastened to a front end of the outer shell adjacent to the assembling end. The protecting element includes a contact end disposed opposite to the connecting end, the connecting end is connected with a middle of the contact end, the middle of the contact end is corresponding to and communicated with a middle of the connecting end, the connecting end and a rear end of the contact end are inserted into the front end of the outer shell, the connecting end and the rear end of the contact end surround the assembling end, a front end of the contact end is exposed out of the outer shell and projects beyond a front surface of the outer shell, an outer peripheral surface of the outer shell is spaced from and projects beyond an outer peripheral surface of the contact end.

Another object of the present invention is to provide a plug connector having a firmly fastened protecting element. The plug connector having a firmly fastened protecting element includes a main body and a shell assembly. The main body includes a circuit board, a connecting element, a soldering element and an inner shell. The connecting element includes an assembling end, and a function end connected with one end of the assembling end. The assembling end is adjacent to and is connected with one end of the circuit board. The soldering element is connected with and soldered on the other end of the circuit board. The soldering element includes a main portion, and a plurality of soldering strips integrally molded to the main portion. Two opposite ends of each soldering strip project beyond a front surface and a rear surface of the main portion. Each soldering strip has a soldering portion and a connecting portion. The soldering portion and the connecting portion project out of the main portion, and project beyond the front surface and the rear surface of the main portion. Each soldering strip is soldered on the other end of the circuit board by virtue of the connecting portion of each soldering strip being soldered on the other end of the circuit board, so that the main portion is fastened to the circuit board. Two opposite sides of the front surface of the main portion adjacent to the circuit board protrude frontward to form two protruding blocks towards the circuit board. The two protruding blocks are disposed opposite to and spaced from the connecting portions of the plurality of the soldering strips for mutually cooperating to clamp the circuit board. The inner shell is fastened between the connecting element and the soldering element. The inner shell surrounds the circuit board. The integrally molded shell assembly surrounding a rear end of the main body. The shell assembly includes an outer shell surrounding the inner shell, and a protecting element integrally molded to a front end of the outer shell and partially projecting into the outer shell. The protecting element includes a connecting end, and a contact end disposed opposite to the connecting end, the connecting end is connected with a middle of the contact end, the middle of the contact end is corresponding to and communicated with a middle of the connecting end, the connecting end and a rear end of the contact end are surrounded by the front end of the outer shell, the connecting end and the rear end of the contact end surround the assembling end, the connecting end is fastened to the front end of the outer shell adjacent to the assembling end, a front end of the contact end is exposed out of the outer shell and projects beyond a front surface of the outer shell, an outer peripheral surface of the outer shell is spaced from and projects beyond an outer peripheral surface of the contact end.

Another object of the present invention is to provide a plug connector having a firmly fastened protecting element. The plug connector having a firmly fastened protecting element includes a circuit board, a connecting element, a soldering element connected with and soldered on the other end of the circuit board, an inner shell, an integrally molded outer shell surrounding the inner shell, and a protecting element. The connecting element includes an assembling end, and a function end connected with one end of the assembling end. The assembling end is adjacent to and is connected with one end of the circuit board. The soldering element includes a main portion, and a plurality of soldering strips integrally molded to the main portion. Two opposite ends of each soldering strip project beyond a front surface and a rear surface of the main portion. Each soldering strip has a soldering portion and a connecting portion. The soldering portion and the connecting portion project out of the main portion, and project beyond the front surface and the rear surface of the main portion. Each soldering strip is soldered on the other end of the circuit board by virtue of the connecting portion of each soldering strip being soldered on the other end of the circuit board, so that the main portion is fastened to the circuit board. Two opposite sides of the front surface of the main portion adjacent to the circuit board protrude frontward to form two protruding blocks towards the circuit board. The two protruding blocks are disposed opposite to and spaced from the connecting portions of the plurality of the soldering strips for mutually cooperating to clamp the circuit board. The inner shell surrounds the circuit board. The inner shell is fastened between the connecting element and the soldering element. The protecting element is integrally molded to a front end of the outer shell adjacent to the assembling end. The protecting element includes a connecting end, and a contact end disposed opposite to the connecting end, the connecting end is connected with a middle of the contact end, the middle of the contact end is corresponding to and communicated with a middle of the connecting end, the connecting end and a rear end of the contact end are surrounded by the front end of the outer shell, the connecting end and the rear end of the contact end surround the assembling end, the connecting end is fastened to the front end of the outer shell adjacent to the assembling end, a front end of the contact end is exposed out of the outer shell and projects beyond a front surface of the outer shell, an outer peripheral surface of the outer shell is spaced from and projects beyond an outer peripheral surface of the contact end.

As described above, the connecting end of the protecting element of the plug connector having a firmly fastened protecting element is combined with and is fastened to the front end of the outer shell by an application of an injection molding technology to mold the protecting element to the outer shell, and then the protecting element is fastened with the outer shell, so that a manufacturing procedure of adopting adhesives to fasten the protecting element and the outer shell is saved and work time of manufacturing the plug connector having a firmly fastened protecting element is saved, and the plug connector having a firmly fastened protecting element has an abrasion-proof protection effect by virtue of the front end of the contact end being exposed out of the outer shell and projecting beyond the front surface of the outer shell. Thereby the plug connector having a firmly fastened protecting element simplifies a manufacturing process and manufacturing procedures. Furthermore, a phenomenon of the outer shell being separated from the protecting element on account of the adhesives having a weak adhesion effect is further prevented from being happened. As a result, the plug connector having a firmly fastened protecting element has shorter manufacturing time, a simple manufacturing process and simple manufacturing procedures, and quality of the plug connector having a firmly fastened protecting element is ensured.

DETAILED DESCRIPTION OF THE PREFERRED EMBODIMENT

Figure 1:
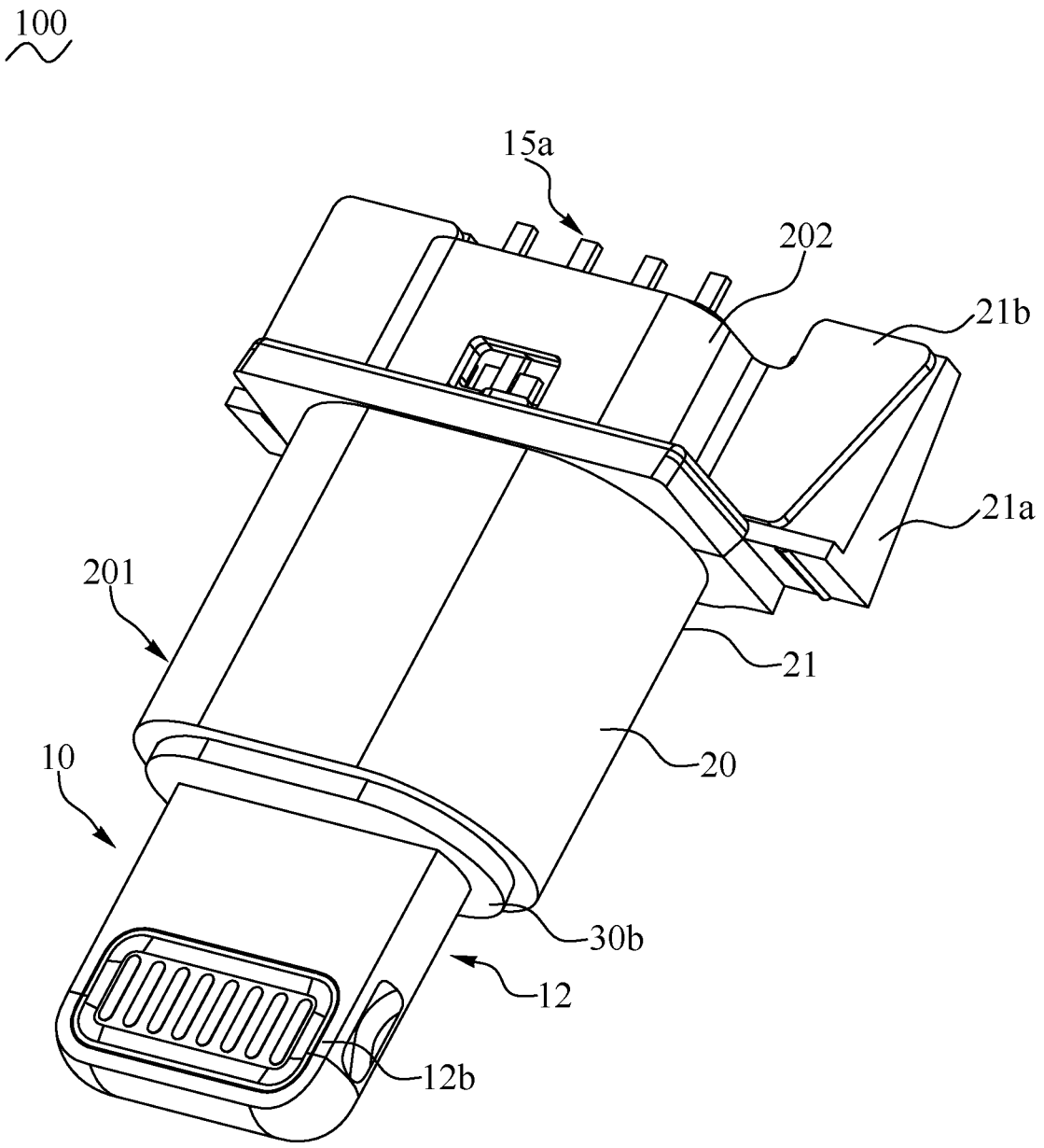
FIG. 1 is a perspective view of a plug connector having a firmly fastened protecting element in accordance with a preferred embodiment of the present invention.
Figure 6:
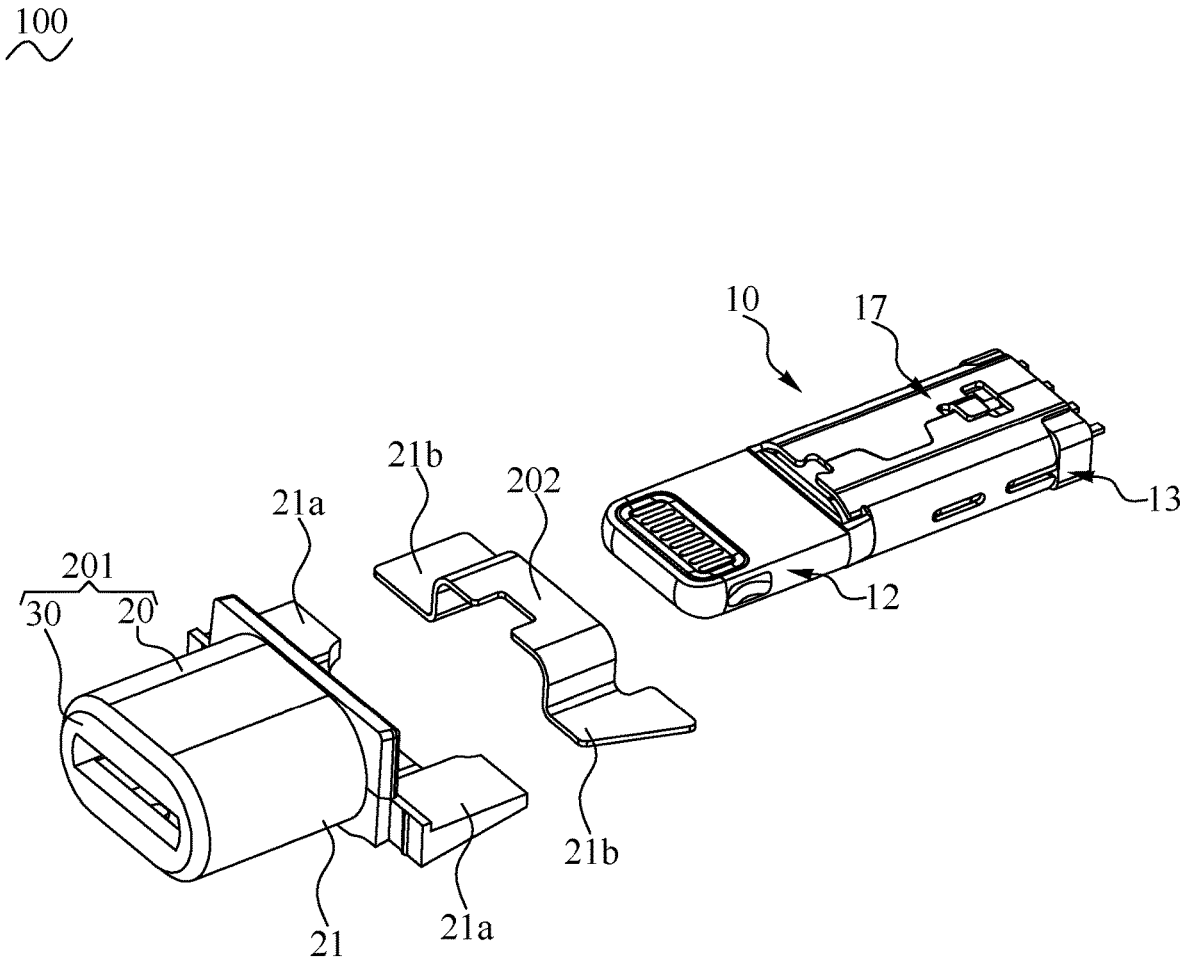
FIG. 6 is a partially exploded view of the plug connector having a firmly fastened protecting element of FIG. 1, wherein the main body is separated from the shell assembly.

With reference to FIG. 1 and FIG. 6, a plug connector having a firmly fastened protecting element 100 in accordance with a preferred embodiment of the present invention is shown. The plug connector having a firmly fastened protecting element 100 includes a main body 10, an integrally molded shell assembly 201 surrounding the main body 10, and a propping element 202. The shell assembly 201 includes an outer shell 20 and a protecting element 30.

Figure 2:
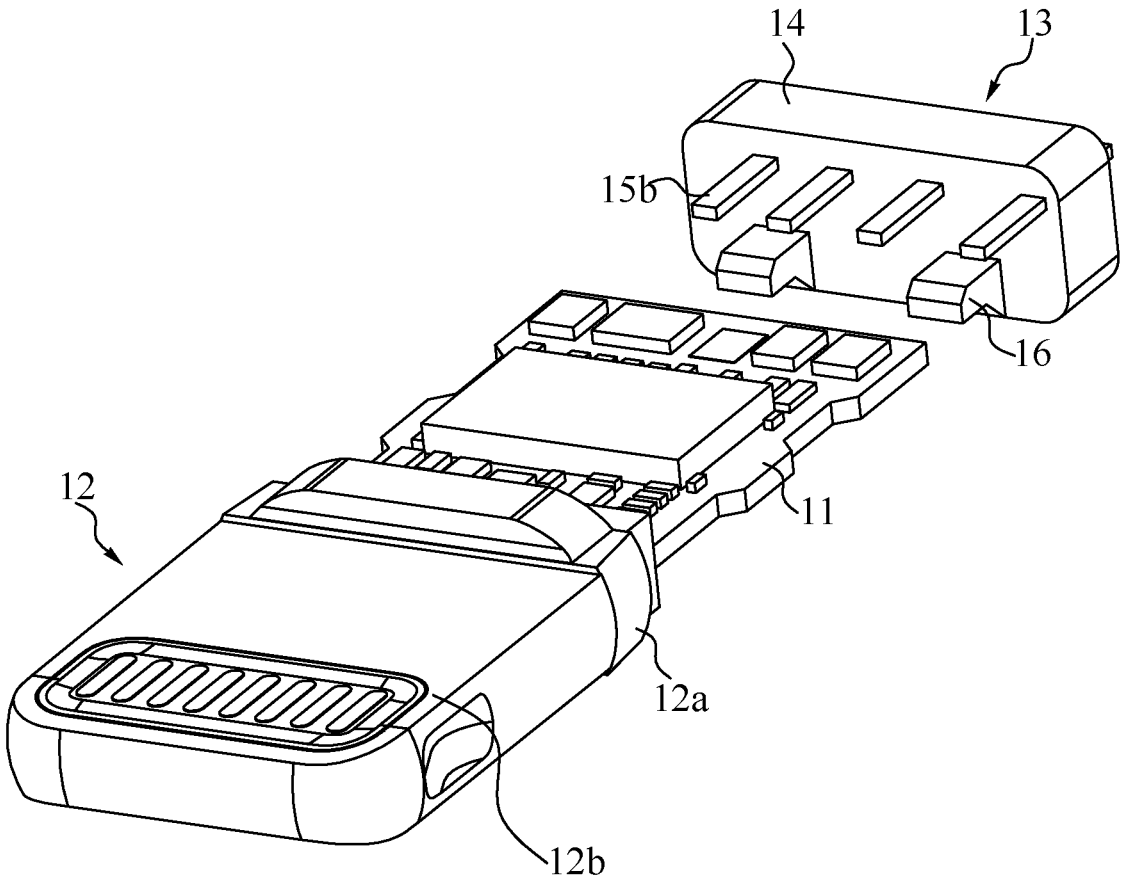
FIG. 2 is an exploded schematic diagram of the plug connector having a firmly fastened protecting element of FIG. 1, wherein a soldering element is separated from a circuit board and a connecting element of a main body of the plug connector having a firmly fastened protecting element of FIG. 1.
Figure 3:
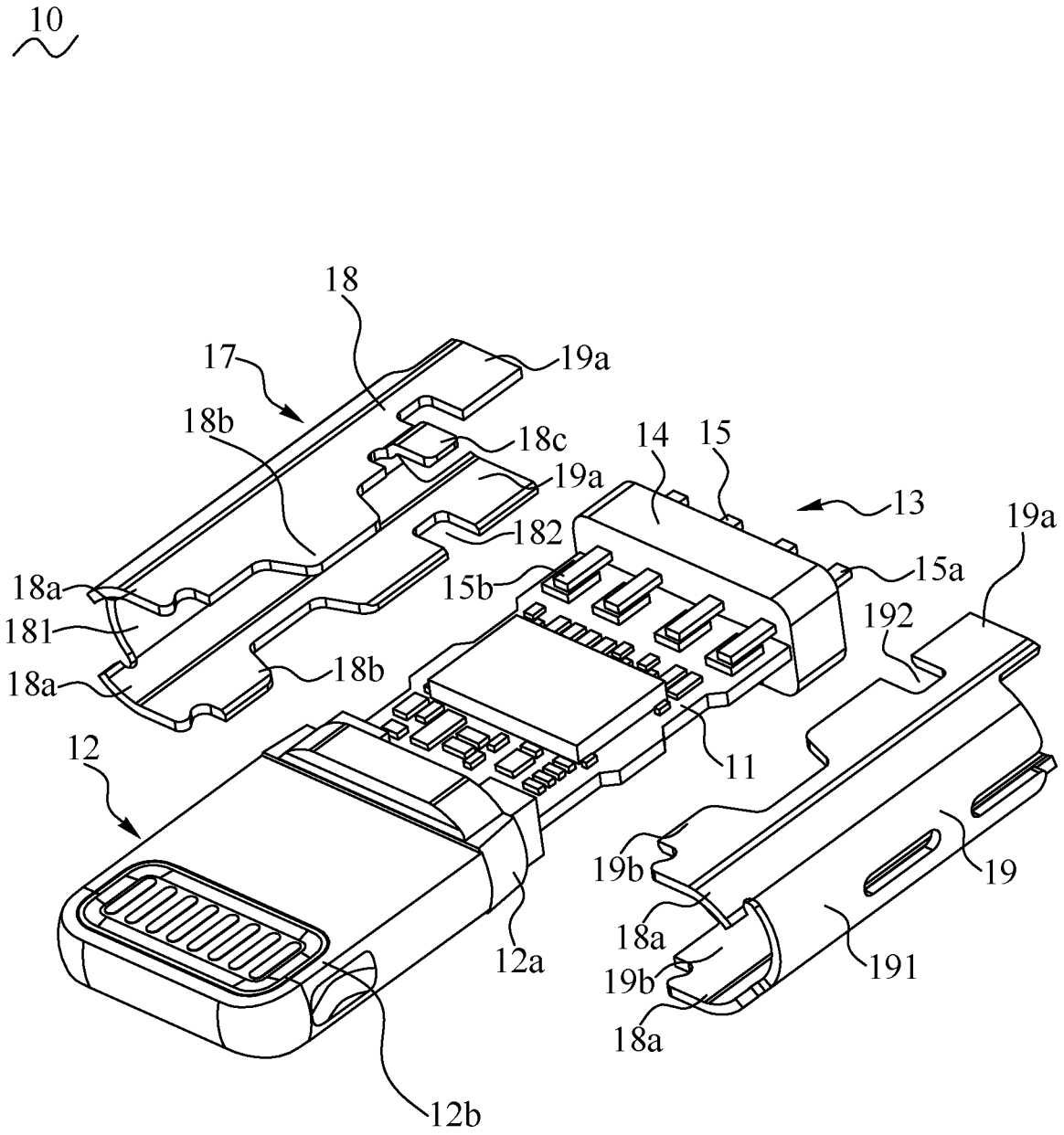
FIG. 3 is a partially exploded view of the main body of the plug connector having a firmly fastened protecting element of FIG. 1.
Figure 4:
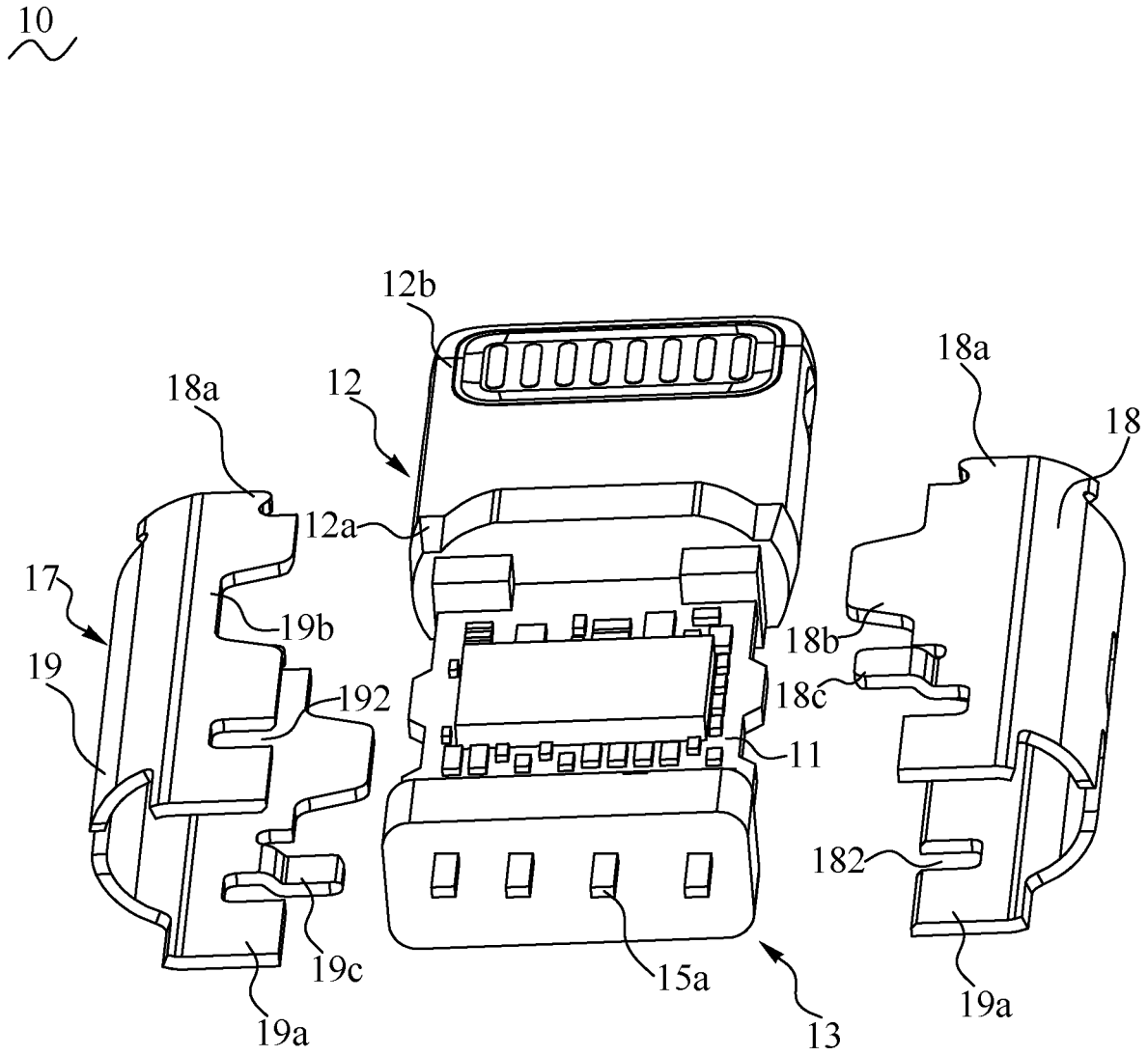
FIG. 4 is another partially exploded view of the main body of the plug connector having a firmly fastened protecting element of FIG. 1.

Referring to FIG. 1 to FIG. 3, the main body 10 includes a circuit board 11, a connecting element 12, a soldering element 13 and an inner shell 17. The inner shell 17 has a location function. The connecting element 12 is connected with one end of the circuit board 11. The connecting element 12 is connected with a front end of the circuit board 11. The soldering element 13 is connected with and soldered on the other end of the circuit board 11. The soldering element 13 is soldered on a rear end of the circuit board 11. The connecting element 12 includes an assembling end 12*a*, and a function end 12*b* connected with one end of the assembling end 12*a*. The function end 12*b* is connected with a front end of the assembling end 12*a*. The assembling end 12*a* is adjacent to and is connected with the one end of the circuit board 11. The assembling end 12*a* and the function end 12*b* are located at two opposite ends of the connecting element 12 and is disposed oppositely, respectively.

The soldering element 13 includes a main portion 14, and a plurality of soldering strips 15 integrally molded to the main portion 14. Preferably, the soldering element 13 includes a main portion 14, and four soldering strips 15 integrally molded to the main portion 14. Two opposite ends of each soldering strip 15 project beyond a front surface and a rear surface of the main portion 14. Each soldering strip 15 has a soldering portion 15*a* and a connecting portion 15*b*. The soldering portion 15*a* and the connecting portion 15*b* project out of the main portion 14, and projects beyond the front surface and the rear surface of the main portion 14. Each soldering strip 15 is soldered on the other end of the circuit board 11 by virtue of the connecting portion 15*b* of each soldering strip 15 being soldered on the other end of the circuit board 11, so that the main portion 14 is fastened to the circuit board 11, and the soldering element 13 is further fastened to the circuit board 11.

In the preferred embodiment, in order to facilitate combining the circuit board 11 with the soldering element 13 and prevent the plurality of the soldering strips 15 from being deformed, two opposite sides of a front surface of the main portion 14 adjacent to the circuit board 11 protrude frontward to form two protruding blocks 16 towards the circuit board 11. The two protruding blocks 16 are disposed opposite to and spaced from the connecting portions 15*b* of the plurality of the soldering strips 15 for mutually cooperating to clamp the circuit board 11. Specifically, the two protruding blocks 16 are disposed opposite to and spaced from the four connecting portions 15*b* of the four soldering strips 15 for mutually cooperating to clamp the circuit board 11. So the circuit board 11 is located to the soldering element 13. Each soldering strip 15 is prevented from being deformed by means of the two protruding blocks 16 sharing bearing forces of the plurality of the soldering strips 15. Each soldering strip 15 is prevented from being deformed by means of the two protruding blocks 16 sharing bearing forces of the four soldering strips 15.

Figure 5:
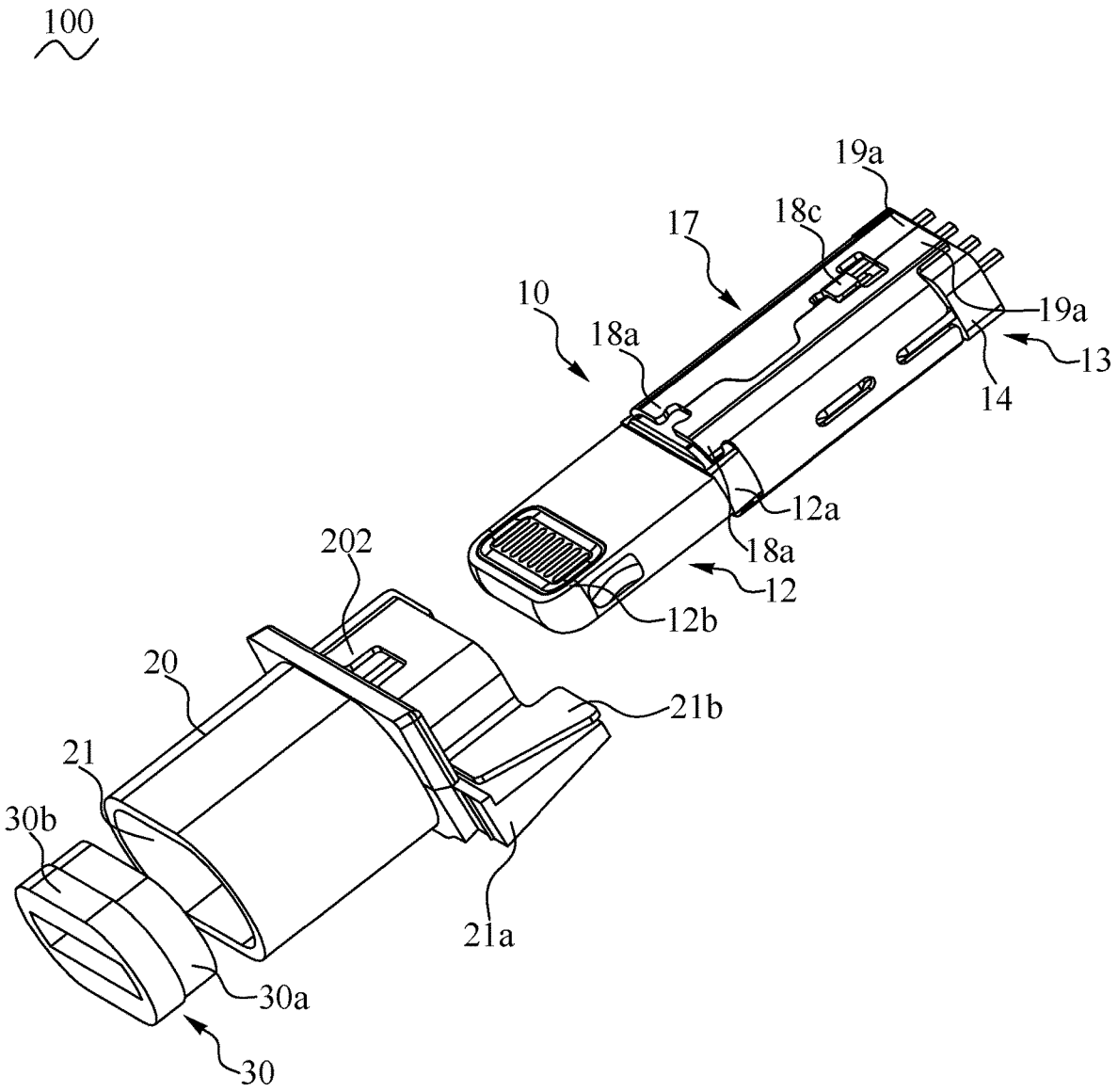
FIG. 5 is a partially exploded view of the plug connector having a firmly fastened protecting element of FIG. 1, wherein an outer shell and a protecting element are separated from the main body.

Referring to FIG. 3 and FIG. 5, in order to protect the circuit board 11 to ensure that the plug connector having a firmly fastened protecting element 100 is used normally, the inner shell 17 is fastened between the connecting element 12 and the soldering element 13. The inner shell 17 surrounds the circuit board 11. The inner shell 17 includes a first inner shell 18 and a second inner shell 19. The first inner shell 18 is of a lying U shape seen from a front view, and the second inner shell 19 is of a lying U shape seen from a front view. A mouth of the first inner shell 18 faces to a mouth of the second inner shell 19. The first inner shell 18 and the second inner shell 19 are assembled to the connecting element 12 and the soldering element 13, and the first inner shell 18 and the second inner shell 19 are located at two opposite sides of the circuit board 11.

A top and a bottom of a front end of the first inner shell 18, and a top and a bottom of a front end of the second inner shell 19 extend outward to form four fastening portions 18*a* opposite to the soldering element 13. The fastening portion 18*a* of the top of the front end of the first inner shell 18 is disposed over the fastening portion 18*a* of the bottom of the front end of the first inner shell 18. The fastening portion 18*a* of the top of the front end of the second inner shell 19 is disposed over the fastening portion 18*a* of the bottom of the front end of the second inner shell 19. A top and a bottom of a rear end of the first inner shell 18, and a top and a bottom of a rear end of the first inner shell 18 extend outward to form four fixing portions 19*a* opposite to the four fastening portions 18*a*. The four fastening portions 18*a* of the first inner shell 18 surround and are connected with the assembling end 12*a*. The four fixing portions 19*a* of the second inner shell 19 surround and are connected with the main portion 14.

The two fastening portions 18*a* of the top of the front end of the first inner shell 18 and the top of the front end of the second inner shell 19 are corresponding to each other. The two fastening portions 18*a* of the bottom of the front end of the first inner shell 18 and the bottom of the front end of the second inner shell 19 are corresponding to each other. The two fixing portions 19*a* of the top of the rear end of the first inner shell 18 and the top of the rear end of the second inner shell 19 are matched with and corresponding to each other. The two fixing portions 19*a* of the bottom of the rear end of the first inner shell 18 and the bottom of the rear end of the second inner shell 19 are matched with and corresponding to each other. The circuit board 11 is fastened in the inner shell 17 by virtue of welding the fastening portions 18*a* of the first inner shell 18 and the second inner shell 19 with the assembling end 12*a*, and welding the fixing portions 19*a* of the first inner shell 18 and the second inner shell 19 with the main portion 14.

In the preferred embodiment, in order to make the first inner shell 18 and the second inner shell 19 combined better, a top edge and a bottom edge of the first inner shell 18 are of concave-convex structures to be defined as two first tenon edges 18*b*, and a top edge and a bottom edge of the second inner shell 19 are of concave-convex structures to be defined as two second tenon edges 19*b*. The first inner shell 18 includes an arc-shaped first connecting shell 181 connected between the two first tenon edges 18*b*. The second inner shell 19 includes an arc-shaped second connecting shell 191 connected between the two second tenon edges 19*b*. The first connecting shell 181 and the second connecting shell 191 are arched oppositely. The two first tenon edges 18*b* of the first inner shell 18 are matched with and corresponding to the two second tenon edges 19*b* of the second inner shell 19, respectively. The first inner shell 18 and the second inner shell 19 facilitate being correspondingly combined by virtue of the two first tenon edges 18*b* of the first inner shell 18 being combined with the two second tenon edges 19*b* of the second inner shell 19.

Referring to FIG. 1 to FIG. 5, in the preferred embodiment, in order to avoid the inner shell 17 from being directly exposed outside to affect an aesthetic feeling of an appearance of the plug connector having a firmly fastened protecting element 100, the outer shell 20 is integrally molded and is made of a plastic material, and the outer shell 20 is disposed to an outer surface of the inner shell 17. The integrally molded outer shell 20 surrounds the outer surface of the inner shell 17 for ensuring that the outer shell 20 is located to the inner shell 17. The first inner shell 18 and the second inner shell 19 further include a first location strap 18*c* and a second location strap 19*c* disposed oppositely. Rears of the first tenon edge 18*b* of an upper portion of the first inner shell 18 and the second tenon edge 19*b* of a lower portion of the second inner shell 19 are oppositely bent outward and then extend towards the circuit board 11 to form the first location strap 18*c* and the second location strap 19*c*, respectively. The first location strap 18*c* and the second location strap 19*c* project beyond a top surface of the first tenon edge 18*b* of the upper portion of the first inner shell 18 and a bottom surface of the second tenon edge 19*b* of the lower portion of the second inner shell 19. Rears of the first tenon edge 18*b* of a lower portion of the first inner shell 18 and the second tenon edge 19*b* of an upper portion of the second inner shell 19 are recessed oppositely to form a first notch 182 and a second notch 192, respectively. The first location strap 18*c* and the second location strap 19*c* are located in the first notch 182 and the second notch 192, respectively. The outer shell 20 is directly fastened to the inner shell 17 through the first location strap 18*c* and the second location strap 19*c*.

Referring to FIG. 1 and FIG. 5, in the preferred embodiment, in order to further protect the soldering element 13 and make the plug connector having a firmly fastened protecting element 100 combined with an outer cover (not shown) of an electronic product (not shown) better, the shell assembly 201 is integrally molded and the integrally molded shell assembly 201 surrounding a rear end of the main body 10, and the outer shell 20 has a surrounding barrel 21 for combining with and fastening with the main body 10. The surrounding barrel 21 of the outer shell 20 is disposed to a rear end of the plug connector having a firmly fastened protecting element 100 and is adjacent to the soldering element 13. Lower portions of two opposite sides of a rear end of the surrounding barrel 21 oppositely extend outward to form two first flanks 21*a*. The propping element 202 is fastened on the rear end of the surrounding barrel 21 of the outer shell 20. Two opposite sides of the propping element 202 oppositely extend outward to form two second flanks 21*b* facing to and located above the two first flanks 21*a*. The surrounding barrel 21 and the propping element 202 surround a rear end of the main body 10. The surrounding barrel 21 surrounds the inner shell 17 and the main portion 14. The two first flanks 21*a* and the two second flanks 21*b* surround a periphery of the main portion 14. The soldering portions 15*a* of the plurality of the soldering strips 15 are exposed out of the surrounding barrel 21.

Referring to FIG. 1 to FIG. 5, in order to protect the aesthetic feeling of the appearance of the plug connector having a firmly fastened protecting element 100 and an aesthetic feeling of the outer cover of the electronic product, and simplify manufacturing procedures of the plug connector having a firmly fastened protecting element 100 and ensure quality of the plug connector having a firmly fastened protecting element 100, the protecting element 30 includes a hollow connecting end 30*a*, and a hollow contact end 30*b* disposed opposite to the connecting end 30*a*. The protecting element 30 is fastened to one end of the main body 10 adjacent to the assembling end 12*a*. The connecting end 30*a* is connected with a middle of the contact end 30*b*. The middle of the contact end 30*b* is corresponding to and communicated with a middle of the connecting end 30*a*. The connecting end 30*a* surrounds the one end of the circuit board 11 adjacent to the assembling end 12*a*. The connecting end 30*a* is combined with and is fastened to one end of the outer shell 20 away from the soldering element 13. Namely, the connecting end 30*a* is combined with and is fastened to a front end of the outer shell 20 adjacent to the assembling end 12*a*. The connecting end 30*a* and a rear end of the contact end 30*b* are inserted into and surrounded by the front end of the outer shell 20. The front end of the outer shell 20 surrounds the connecting end 30*a*.

The connecting end 30*a* and the rear end of contact end 30*b* surrounds the assembling end 12*a*. A front end of the contact end 30*b* is exposed out of the outer shell 20 and projects beyond a front surface of the outer shell 20. An outer peripheral surface of the outer shell 20 is spaced from and projects beyond an outer peripheral surface of the contact end 30*b*. The plug connector having a firmly fastened protecting element 100 has an abrasion-proof protection effect by virtue of the front end of the contact end 30*b* being exposed out of the outer shell 20 and projecting beyond the front surface of the outer shell 20. The protecting element 30 adopts a silicone material. The protecting element 30 is integrally molded to the front end of the outer shell 20 by an injection molding technology and partially projects into the outer shell 20. The outer shell 20 is isolated from the outer cover of the electronic product through the contact end 30*b*, so that the outer cover of the electronic product is prevented from being scratched or abraded, and simultaneously, the connecting end 30*a* is combined with and is fastened to the front end of the outer shell 20 by an application of the injection molding technology to mold the protecting element 30 to the outer shell 20, and then the protecting element 30 is fastened with the outer shell 20.

As described above, the connecting end 30*a* of the protecting element 30 of the plug connector having a firmly fastened protecting element 100 is combined with and is fastened to the front end of the outer shell 20 by the application of the injection molding technology to mold the protecting element 30 to the outer shell 20, and then the protecting element 30 is fastened with the outer shell 20, so that a manufacturing procedure of adopting adhesives to fasten the protecting element 30 and the outer shell 20 is saved and work time of manufacturing the plug connector having a firmly fastened protecting element 100 is saved, and the plug connector having a firmly fastened protecting element 100 has the abrasion-proof protection effect by virtue of the front end of the contact end 30*b* being exposed out of the outer shell 20 and projecting beyond the front surface of the outer shell 20. Thereby the plug connector having a firmly fastened protecting element 100 simplifies a manufacturing process and manufacturing procedures. Furthermore, a phenomenon of the outer shell 20 being separated from the protecting element 30 on account of the adhesives having a weak adhesion effect is further prevented from being happened. As a result, the plug connector having a firmly fastened protecting element 100 has shorter manufacturing time, a simple manufacturing process and simple manufacturing procedures, and quality of the plug connector having a firmly fastened protecting element 100 is ensured.

What is claimed is:

1. A plug connector having a firmly fastened protecting element, comprising:

a main body including a circuit board, a connecting element, a soldering element and an inner shell, the connecting element including an assembling end, and a function end connected with one end of the assembling end, the assembling end being adjacent to and being connected with one end of the circuit board, the soldering element being connected with and soldered on the other end of the circuit board, the soldering element including a main portion, and a plurality of soldering strips integrally molded to the main portion, two opposite ends of each soldering strip projecting beyond a front surface and a rear surface of the main portion, each soldering strip having a soldering portion and a connecting portion, the soldering portion and the connecting portion projecting out of the main portion, and projecting beyond the front surface and the rear surface of the main portion, each soldering strip being soldered on the other end of the circuit board by virtue of the connecting portion of each soldering strip being soldered on the other end of the circuit board, so that the main portion is fastened to the circuit board, two opposite sides of the front surface of the main portion adjacent to the circuit board protruding frontward to form two protruding blocks towards the circuit board, the two protruding blocks being disposed opposite to and spaced from the connecting portions of the plurality of the soldering strips for mutually cooperating to clamp the circuit board, the inner shell being fastened between the connecting element and the soldering element, the inner shell surrounding the circuit board;

an integrally molded outer shell surrounding the inner shell; and a protecting element fastened to one end of the main body adjacent to the assembling end, the protecting element including a connecting end, the connecting end being combined with and being fastened to one end of the outer shell away from the soldering element, the connecting end being fastened to a front end of the outer shell adjacent to the assembling end, wherein the protecting element includes a contact end disposed opposite to the connecting end, the connecting end is connected with a middle of the contact end, the middle of the contact end is corresponding to and communicated with a middle of the connecting end, the connecting end and a rear end of the contact end are inserted into the front end of the outer shell, the connecting end and the rear end of the contact end surround the assembling end, a front end of the contact end is exposed out of the outer shell and projects beyond a front surface of the outer shell, an outer peripheral surface of the outer shell is spaced from and projects beyond an outer peripheral surface of the contact end.

2. The plug connector having a firmly fastened protecting element as claimed in claim 1, wherein the connecting end surrounds the one end of the circuit board adjacent to the assembling end, the front end of the outer shell surrounds the connecting end.

3. The plug connector having a firmly fastened protecting element as claimed in claim 1, wherein the protecting element is integrally molded to the front end of the outer shell and partially projects into the outer shell.

4. A plug connector having a firmly fastened protecting element, comprising:

a main body including a circuit board, a connecting element, a soldering element and an inner shell, the connecting element including an assembling end, and a function end connected with one end of the assembling end, the assembling end being adjacent to and being connected with one end of the circuit board, the soldering element being connected with and soldered on the other end of the circuit board, the soldering element including a main portion, and a plurality of soldering strips integrally molded to the main portion, two opposite ends of each soldering strip projecting beyond a front surface and a rear surface of the main portion, each soldering strip having a soldering portion and a connecting portion, the soldering portion and the connecting portion projecting out of the main portion, and projecting beyond the front surface and the rear surface of the main portion, each soldering strip being soldered on the other end of the circuit board by virtue of the connecting portion of each soldering strip being soldered on the other end of the circuit board, so that the main portion is fastened to the circuit board, two opposite sides of the front surface of the main portion adjacent to the circuit board protruding frontward to form two protruding blocks towards the circuit board, the two protruding blocks being disposed opposite to and spaced from the connecting portions of the plurality of the soldering strips for mutually cooperating to clamp the circuit board, the inner shell being fastened between the connecting element and the soldering element, the inner shell surrounding the circuit board; and an integrally molded shell assembly surrounding a rear end of the main body, the shell assembly including an outer shell surrounding the inner shell, and a protecting element integrally molded to a front end of the outer shell and partially projecting into the outer shell;

wherein the protecting element includes a connecting end, and a contact end disposed opposite to the connecting end, the connecting end is connected with a middle of the contact end, the middle of the contact end is corresponding to and communicated with a middle of the connecting end, the connecting end and a rear end of the contact end are surrounded by the front end of the outer shell, the connecting end and the rear end of the contact end surround the assembling end, the connecting end is fastened to the front end of the outer shell adjacent to the assembling end, a front end of the contact end is exposed out of the outer shell and projects beyond a front surface of the outer shell, an outer peripheral surface of the outer shell is spaced from and projects beyond an outer peripheral surface of the contact end.

5. The plug connector having a firmly fastened protecting element as claimed in claim 4, wherein the connecting end surrounds the one end of the circuit board adjacent to the assembling end, the connecting end is combined with and is fastened to one end of the outer shell away from the soldering element.

6. A plug connector having a firmly fastened protecting element, comprising:

a circuit board;

a connecting element including an assembling end, and a function end connected with one end of the assembling end, the assembling end being adjacent to and being connected with one end of the circuit board;

a soldering element connected with and soldered on the other end of the circuit board, the soldering element including a main portion, and a plurality of soldering strips integrally molded to the main portion, two opposite ends of each soldering strip projecting beyond a front surface and a rear surface of the main portion, each soldering strip having a soldering portion and a connecting portion, the soldering portion and the connecting portion projecting out of the main portion, and projecting beyond the front surface and the rear surface of the main portion, each soldering strip being soldered on the other end of the circuit board by virtue of the connecting portion of each soldering strip being soldered on the other end of the circuit board, so that the main portion is fastened to the circuit board, two opposite sides of the front surface of the main portion adjacent to the circuit board protruding frontward to form two protruding blocks towards the circuit board, the two protruding blocks being disposed opposite to and spaced from the connecting portions of the plurality of the soldering strips for mutually cooperating to clamp the circuit board;

an inner shell surrounding the circuit board, the inner shell being fastened between the connecting element and the soldering element;

an integrally molded outer shell surrounding the inner shell; and a protecting element integrally molded to a front end of the outer shell adjacent to the assembling end;

wherein the protecting element includes a connecting end, and a contact end disposed opposite to the connecting end, the connecting end is connected with a middle of the contact end, the middle of the contact end is corresponding to and communicated with a middle of the connecting end, the connecting end and a rear end of the contact end are surrounded by the front end of the outer shell, the connecting end and the rear end of the contact end surround the assembling end, the connecting end is fastened to the front end of the outer shell adjacent to the assembling end, a front end of the contact end is exposed out of the outer shell and projects beyond a front surface of the outer shell, an outer peripheral surface of the outer shell is spaced from and projects beyond an outer peripheral surface of the contact end.

* * * * *